US009693638B1

(12) United States Patent
Leach

(10) Patent No.: US 9,693,638 B1
(45) Date of Patent: Jul. 4, 2017

(54) RECONFIGURABLE PILLOW WITH DUAL INFANT SUPPORT PILLOWS

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 0 days.

(21) Appl. No.: 14/844,705

(22) Filed: Sep. 3, 2015

(51) Int. Cl.
*A47G 9/00* (2006.01)
*A47D 13/08* (2006.01)
*A47C 20/02* (2006.01)

(52) U.S. Cl.
CPC ..... *A47D 13/08* (2013.01); *A47C 20/02* (2013.01)

(58) Field of Classification Search
CPC ..... A47G 9/00
USPC ..... 5/655, 632, 630, 636, 640, 652
See application file for complete search history.

(56) References Cited

U.S. PATENT DOCUMENTS

| | | | |
|---|---|---|---|
| 2,953,793 | A | 9/1960 | Rossi |
| 3,327,330 | A | 6/1967 | McCullough |
| 3,899,797 | A | 8/1975 | Gunst |
| 4,731,890 | A | 3/1988 | Roberts |
| D299,988 | S | 2/1989 | Parabita |
| 4,834,459 | A | 5/1989 | Leach |
| 4,861,109 | A | 8/1989 | Leach |
| D303,897 | S | 10/1989 | Phillips |
| D309,018 | S | 7/1990 | Leach |
| D318,969 | S | 8/1991 | Byrn |
| 5,103,514 | A | 4/1992 | Leach |
| 5,325,818 | A | 7/1994 | Leach |
| 5,519,906 | A | 5/1996 | Fanto-Chan |
| 5,581,833 | A | 12/1996 | Zenoff |
| 6,052,848 | A | 4/2000 | Kelly |
| 6,088,854 | A | 7/2000 | Brownrigg |
| 6,279,185 | B1 | 8/2001 | Matthews |
| 6,343,727 | B1 | 2/2002 | Leach |
| 6,412,128 | B1 | 7/2002 | Matthews |
| 6,427,251 | B1 | 8/2002 | Leach |
| 6,484,337 | B1 | 11/2002 | Moe et al. |
| 6,499,164 | B1 | 12/2002 | Leach |
| 6,553,590 | B1 | 4/2003 | Leach |
| 6,601,252 | B1 | 8/2003 | Leach |
| 6,751,817 | B1 | 6/2004 | Leach |
| 6,760,934 | B1 | 7/2004 | Leach |
| 6,795,990 | B1 | 9/2004 | Hutchinson |
| 6,874,183 | B1 | 4/2005 | Taylor |

(Continued)

OTHER PUBLICATIONS

The "All Nighter" product shown in the webpage from http://www.leachco.com published by Leachco, Inc. (Ada, OK, USA) on Oct. 11, 2007, was in public use and/or on sale at least since about May 2002.

(Continued)

*Primary Examiner* — Fredrick Conley
(74) *Attorney, Agent, or Firm* — Mary M. Lee

(57) ABSTRACT

A support pillow with dual infant support pillows that can be configured in a face-to-face or opposing position and, alternately, in a side-by-side flanking position. Two C-shaped pillow segments are joined on one side by a hinge or joint. When the joint is open, the adjoining arms are generally co-linear. When the support pillow is folded at the joint, the two adjoining arms of the C-shaped pillow segments are adjacent and generally parallel. A supportive body wrap may be included for one or both pillow segments. The support pillow may also serve as a body or maternity pillow for a single adult. Additionally, the joint allows the pillow to be folded for use as a study or lounging pillow for an adult or older child. Still further, the pillow can be used as a nursing pillow with attached back support for mothers and caregivers.

26 Claims, 13 Drawing Sheets

(56) References Cited

U.S. PATENT DOCUMENTS

| | | | | |
|---|---|---|---|---|
| 7,010,821 | B1 * | 3/2006 | Leach | A47D 13/083 5/636 |
| 7,114,206 | B2 | 10/2006 | Leach | |
| 7,331,073 | B2 | 2/2008 | Littlehorn et al. | |
| 7,353,552 | B2 | 4/2008 | Leach | |
| 7,404,222 | B2 | 7/2008 | Tidwell | |
| 7,500,278 | B2 | 3/2009 | Leach | |
| 7,513,001 | B1 | 4/2009 | Leach | |
| 7,540,049 | B2 | 6/2009 | Sklenarik et al. | |
| 7,562,406 | B1 * | 7/2009 | Leach | A47C 16/00 5/632 |
| 7,676,871 | B1 | 3/2010 | Leach | |
| 7,708,342 | B2 | 5/2010 | Leach | |
| 7,793,371 | B1 | 9/2010 | Leach | |
| 7,878,587 | B1 | 2/2011 | Leach | |
| 7,926,135 | B1 | 4/2011 | Leach | |
| 8,136,186 | B1 | 3/2012 | Leach | |
| 8,146,760 | B1 | 4/2012 | Leach | |
| 8,419,128 | B1 | 4/2013 | Leach | |
| 8,448,275 | B1 | 5/2013 | Leach | |
| 8,468,627 | B2 | 6/2013 | Leach | |
| 8,479,334 | B1 | 7/2013 | Leach | |
| 8,555,429 | B2 | 10/2013 | Leach | |
| 8,661,587 | B1 | 3/2014 | Leach | |
| 8,661,588 | B1 | 3/2014 | Leach | |
| 8,671,480 | B1 | 3/2014 | Leach | |
| 8,914,927 | B1 | 12/2014 | Leach | |
| 9,003,565 | B1 | 4/2015 | Leach | |
| 9,021,635 | B1 | 5/2015 | Leach | |
| 9,032,572 | B1 | 5/2015 | Leach | |
| 9,101,169 | B1 | 8/2015 | Leach | |
| 9,113,718 | B1 | 8/2015 | Leach | |
| 2002/0029422 | A1 | 3/2002 | Matthews | |
| 2005/0278864 | A1 * | 12/2005 | Leach | A47C 20/021 5/732 |
| 2006/0031992 | A1 | 2/2006 | Moore | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0277321 | A1 | 12/2007 | Leach | |
| 2008/0028529 | A1 | 2/2008 | Abell | |
| 2009/0007335 | A1 | 1/2009 | Tidwell | |
| 2009/0094752 | A1 | 4/2009 | Gagliano et al. | |
| 2009/0133193 | A1 | 5/2009 | Weise | |

OTHER PUBLICATIONS

The "Preggle" product shown in the webpage from http://www.leachco.com published by Leachco, Inc. (Ada, OK, USA) on Jul. 29, 2008,was in public use and/or on sale at least since about Dec. 2006.

The "Snoogle Loop" product shown in the webpage from http://www.leachco.com published by Leachco, Inc. (Ada, DD, USA) on Jun. 19, 2008, was in public use and/or on sale at least since about Dec. 1999.

The "Snoogle" product shown in the webpage from http://www.leachco.com published by Leachco, Inc. (Ada, OK, USA) on Oct. 8, 2007, was in public use and/or on sale at least since about May 1999.

The "Cuddle-U" product shown in the webpage from http://www.leachco.com published by Leachco, Inc. (Ada, OK, USA) on Jul. 29, 2008, was in public use and/or on sale at least since prior about May 2003.

The "Back 'N. Belly" product shown in the webpage from http://www.leachco.com published by Leachco, Inc. (Ada, OK, USA) on Oct. 11, 2007, was in public use and/or on sale at least since about Jun. 2003.

The "Two-By-You" product shown in the webpage from http://www.leachco.com published by Leachco, Inc. (Ada, OK, USA) on Jun. 19, 2008, was in public use and/or on sale at least since about about Oct. 2005.

The "Lil' Snoogle" product shown in the webpage from http://www.leachco.com published by Leachco, Inc. (Ada, OK, USA) on Oct. 11, 2007, was in public use and/or on sale at least since about Dec. 1999.

The "Snoogle Mlni" product shown in the webpage from http://www.leachco.com published by Leachco, Inc. (Ada, OK, USA) on Oct. 11, 2007, was in public use and/or on sale at least since about Dec. 1999.

The "Snoogle Half-Time" product shown in the webpage from http://www.leachco.com published by Leachco, Inc. (Ada, OK, USA) on Oct. 11, 2007, was in public use and/or on sale at least since about Jul. 2005.

The Grow to Sleep product shown in the webpage from http://www.leachco.com published by Leachco, Inc. (Ada, DK, USA) on Jun. 18, 2008, was in public use and/or on sale at least since about Aug. 2005.

The "SnooZoo" product shown in the webpage from http://www.leachco.com published by Leachco, Inc. (Ada, OK, USA) on Oct. 11, 2007, was in public use and/or on sale at least since about May 2005.

The "Hooked on Comfort" product shown in the webpage from http://www.babyage.com published by BabyAge, Inc. (Wilkes Barre, PA ) on Oct. 26, 2006, was in public use and/or on sale at least since prior to the filing date of this application, that is, prior to Sep. 3, 2015.

* cited by examiner

RECONFIGURABLE PILLOW WITH DUAL INFANT SUPPORT PILLOWS

FIELD OF THE INVENTION

The present invention relates generally to pillows and more particularly, but without limitation, to support pillows for infants and toddlers.

BACKGROUND OF THE INVENTION

Infant support pillows have become an important infant care accessory. They are lightweight, washable and serve many functions. Conventional C-shaped pillows allow an infant to be supported on its back in a reclining position or on its tummy for play time. Support pillows for multiple infants, such as twins or triplets, are also commercially available. There remains a need, however, for infant support pillows with more versatility. Specifically, there is a need for a support pillow that will accommodate two infants in different positions.

DETAILED DESCRIPTION OF THE PREFERRED EMBODIMENTS

Figure 1:
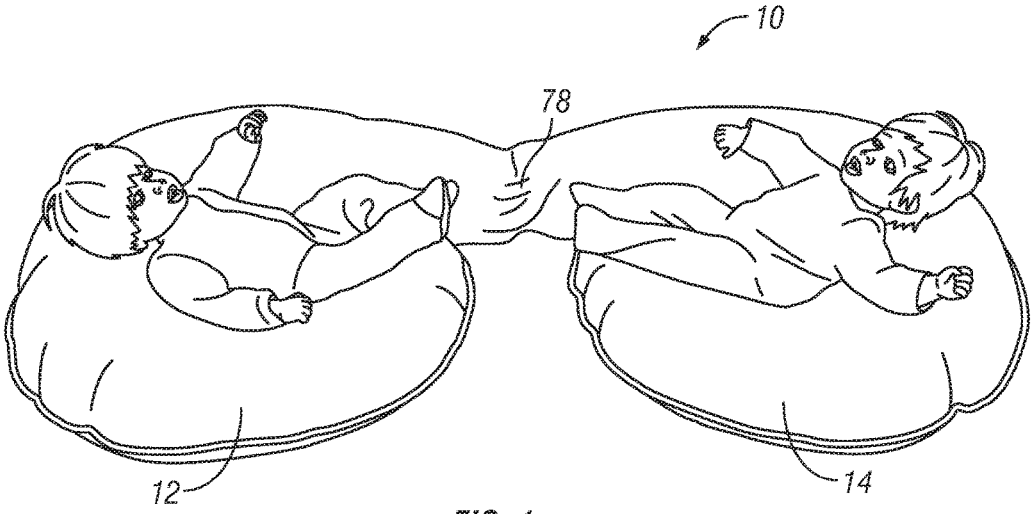
FIG. 1 is a frontal perspective view of a support pillow made with dual infant support pillow segments in accordance with the present invention. The pillow is shown in a first, opposing position. An infant is shown reclining in each well so that they face each other.

The present invention provides a support pillow especially suited for use with two babies. The inventive support pillow comprises two C-shaped infant support pillows joined by a hinge or joint between the ends of one of the two arms on each pillow. The two C-shaped pillow segments can support two babies separate from but adjacent to one another, each secure in its own well. The joint allows the two pillows to be arranged face-to-face in an opposing configuration or side-by-side in a flanking configuration. Additionally, this pillow has alternate configurations useful for older children and adults.

Turning now to the drawings in general and to FIGS. 1-4 in particular, there is shown therein a support pillow made in accordance with a preferred embodiment of the present invention and designated generally by the reference numeral 10. The pillow 10 generally comprises first and second C-shaped pillow segments 12 and 14.

The first C-shaped pillow segment 12 comprises a center section 16 with first and second ends generally at 18 and 20. A first arm 22 extends from the first end 18 of the center section 16, and a second arm 24 extends from the second end 20 of the center section. The first arm 22 has a free end 26 generally opposite the center section 16, and the second arm 24 has an end 28 opposite the center section. The C-shaped segment 12 forms a central well 30, and the ends 26 and 28 of the first and second arms 22 and 24 form a frontal opening 32 to the well.

The second C-shaped pillow segment 14 comprises a center section 40 with first and second ends generally at 42 and 44. A first arm 46 extends from the first end 42 of the center section 40, and a second arm 48 extends from the second end 44 of the center section. The first arm 46 has a free end 50 generally opposite the center section 40, and the second arm 48 has an end 52 opposite the center section. The C-shaped segment 14 forms a central well 56, and the ends 50 and 52 of the first and second arms 46 and 48 form a frontal opening 58 to the well.

As shown herein, the size and shape of the C-shaped segments 12 and 14 are about the same. However, the sizes of the two segments could be different. For example, one pillow segment could be sized for a larger or older infant, while the other is sized for a smaller, younger, or premature infant. As used herein, "C-shaped" denotes any configuration that defines a central well that is at least partially enclosed.

As shown herein, each of the pillow segments 12 and 14 is a generally continuous curve with the ends of the arms being inwardly curved toward each other. However, the pillow segments could be angular. For example, the pillow segments could be a U-shape, either squared or curved. Additionally, the term "frontal opening" refers to an access point for the central well and does require that the ends of the arms be spaced apart any distance. Indeed, in the preferred embodiment shown, the ends of the arms extend inwardly so that they touch or almost touch when in a resting state.

The parts of the pillow segments 12 and 14 are designated only generally. The terms "center section" and "ends" denoting only general regions are not precisely delineated.

Each of the first and second C-shaped segments 12 and 14 is comprised of compressible, resilient material so that each of the pillow segments provides good cushioning and returns to its original shape or resting position after being deformed. As used herein, "resting position" refers to the position and shape the pillow 10 or pillow segment 12 or 14 naturally assumes when no tension or pressure is exerted on any part of it.

Figure 2:
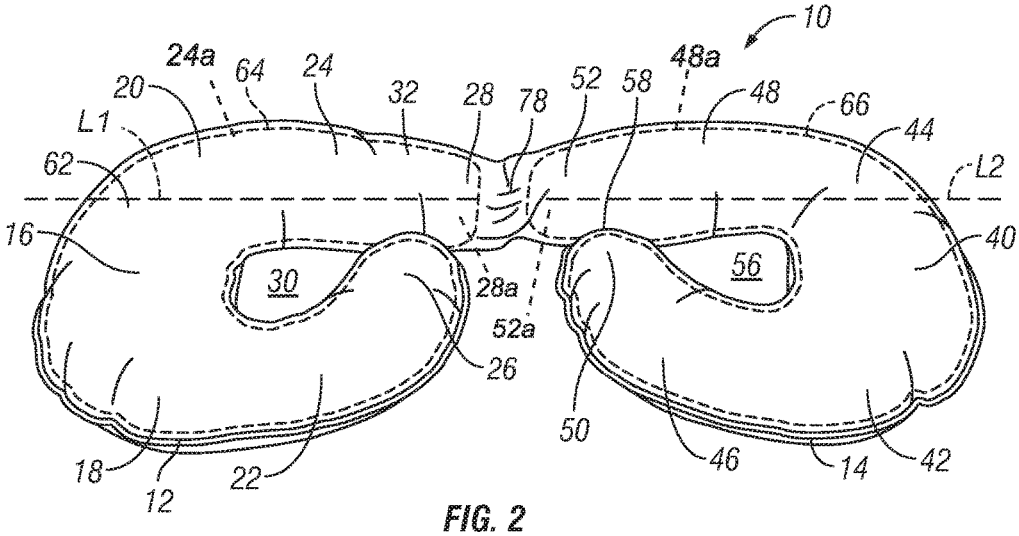
FIG. 2 is a frontal perspective view of the pillow shown in FIG. 1, without the infants.

As best seen in FIG. 2, the pillow 10 preferably comprises a continuous or unitary fabric cover 62 that contains two C-shaped pillow inserts 64 and 66, each such insert typically comprising a fabric enclosure filled with a compressible, resilient material. The fabric cover 62 as well as the fabric enclosures of the pillow inserts 64 and 66 may be any suitable fabric, including but not limited to waterproof nylon, flannel, or elastic fabrics, such as spandex or cotton-spandex blends. However, presently a polyester/cotton blend is preferred. The compressible, resilient material may be solid or loose. For example, a preferred loose filler is polyester fiberfill. Other suitable fillers include down feathers, memory foam, or polystyrene pellets. In some instances, the pillow inserts 64 and 66 may be inflatable.

Figure 3:
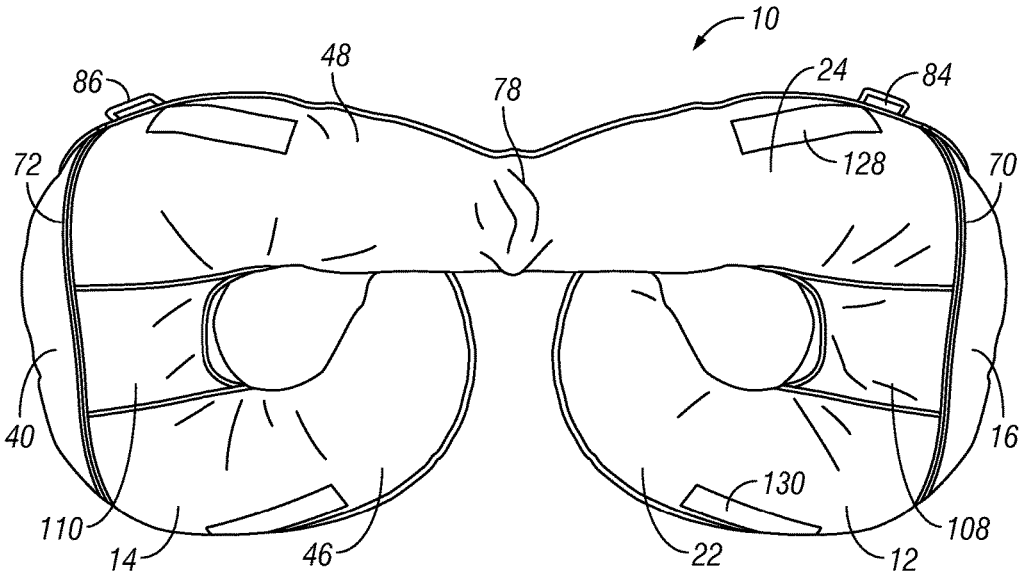
FIG. 3 is a bottom view of the pillow shown in FIG. 2.
Figure 4:
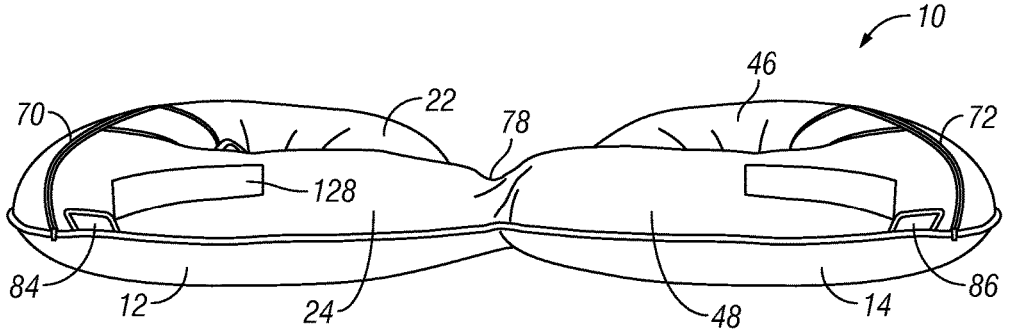
FIG. 4 is a rear view of the pillow shown in FIG. 2.
Figure 5:
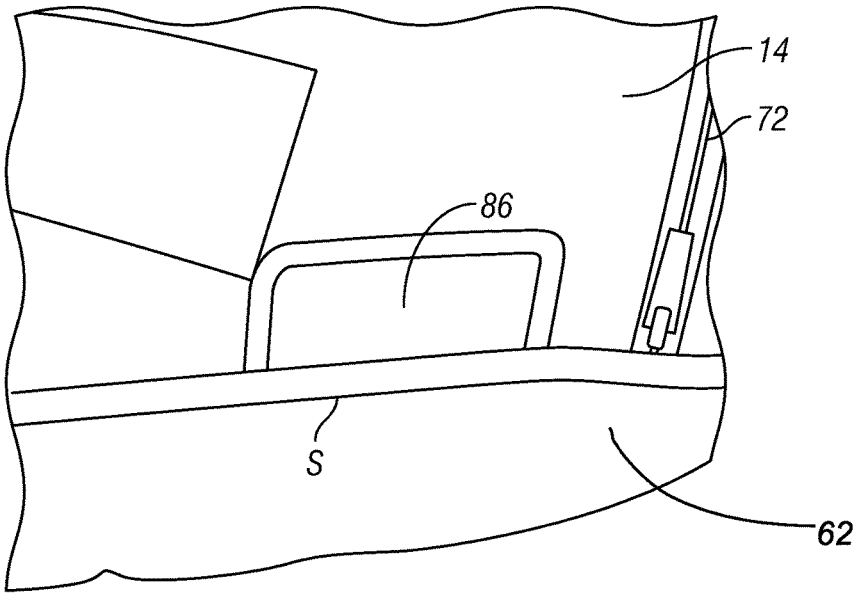
FIG. 5 is an enlarged, fragmented view of the outer periphery of one of the two C-shaped pillows showing the connector tab extending from the side seam.
Figure 6:
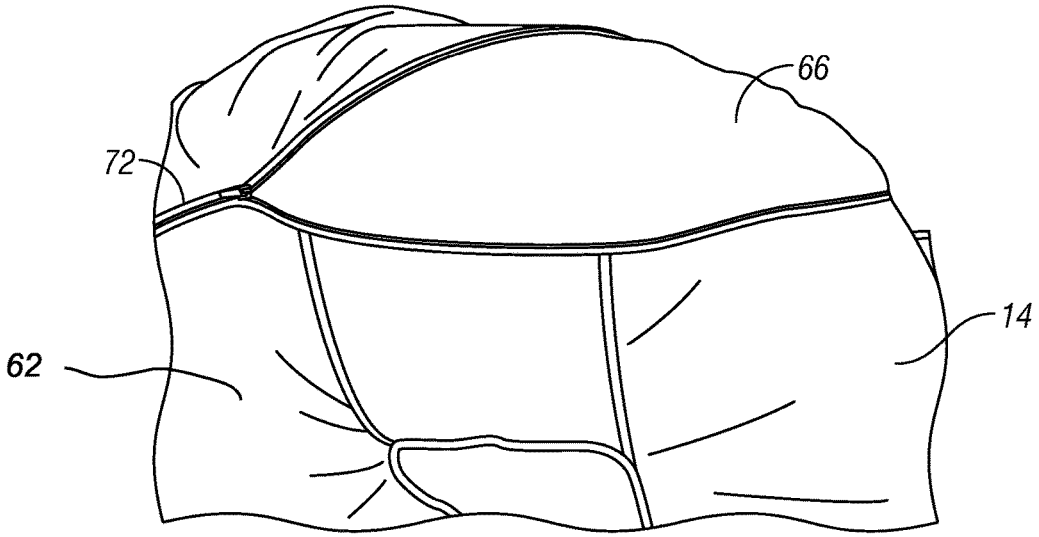
FIG. 6 is an enlarged, fragmented view of the bottom of the center section of one of the two C-shaped pillow segments showing the zipper partially opened to reveal the pillow insert inside.

As indicated, the fabric cover 62 may be removable for easy cleaning. To that end, each end of the cover 62 may be provided with a zipper 70 and 72 along the outer back of the center sections 16 and 40, as best seen in FIG. 3. Alternately, the closure for the fabric cover 62 may include but is not limited to buttons, snaps, ties, hook and loop connectors, or simply overlapping edges (not shown). Although the fabric of which the cover 62 is made may vary widely, a soft cotton fabric is highly preferred in most instances.

In the preferred embodiment, a hinge or joint 78 connects the end 28 of the second arm 24 of the first C-shaped segment 12 and the end 52 of the second arm 48 of the second C-shaped segment 14. As used herein, "joint" refers to a natural break or fold line between the pillow segments 12 and 14.

Now it will be appreciated that the inserts 64 and 66 are sized so that the ends 28*a* and 52*a* of the arms 24*a* and 48*a* (FIG. 2) generally correspond to the ends 26 and 28 of the second arm 24 of the first C-shaped segment 12 and the end 52 of the second arm 48 of the second C-shaped segment 14, respectively. More preferably, the ends 28*a* and 52*a* of the insert are sized, relative to the size and shape of the cover 62, so that there is a slight distance between them. In this way, the joint 78 is conveniently formed by the unfilled space inside the cover 62 between the ends 28*a* and 52*a*.

It will now be apparent, however, that the joint 78 may be formed in several other ways. For example, one or more lines of stitching or a seam made across the tubular section of the cover 62 would form a natural fold line. Alternately, the pillow 10 could be formed with two separable pillow segments—each with its own cover and pillow insert—that attach to each other along the joint line by hook-and-loop strips, a zipper or some other form of attachment.

Now it will be appreciated that, as shown and described, the pillow 10 in its resting state, assumes a first opposing position with the joint 78 open so that the second arm 24 of the first C-shaped segment 12 and the second arm 48 of the second C-shaped segment 14 are generally co-linear. This is indicated by the dashed lines L1 and L2 in FIG. 2. In this position, the first and second C-shaped segments 12 and 14 are arranged face-to-face with the frontal opening 32 of the well 30 of the first C-shaped segment 12 opposite the frontal opening 58 of the well 56 of the second C-shaped segment 14. In this configuration, as seen best in FIG. 1, infants seated or reclining in the pillow segments 12 and 14 can interact with each other verbally and visually.

Figure 7:
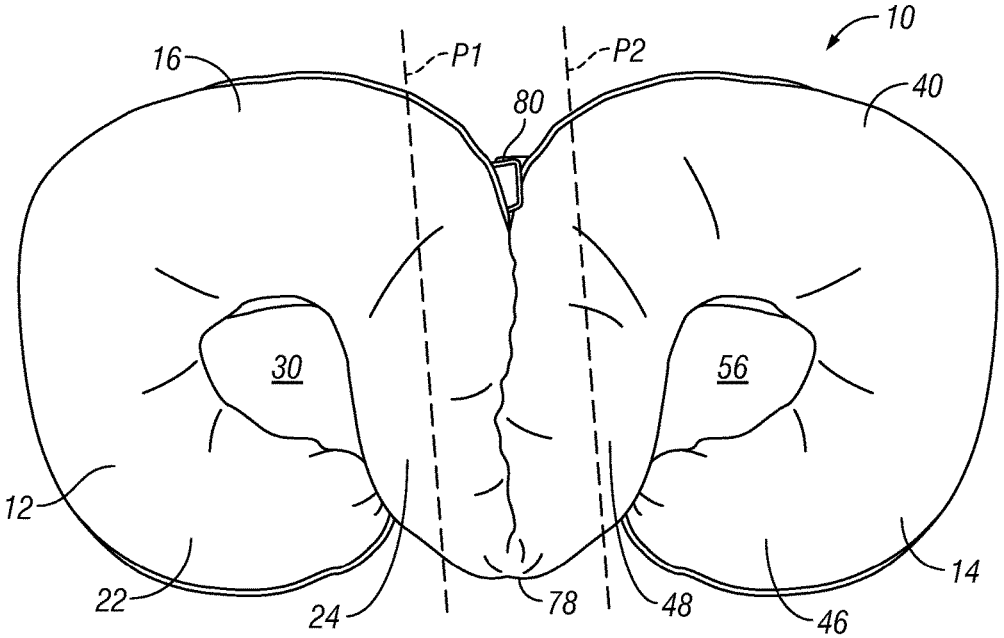
FIG. 7 is a plan view of the pillow of FIG. 2 with the tabs connected to secure the two C-shaped pillow segments in a second, side-by-side or flanking configuration.
Figure 8:
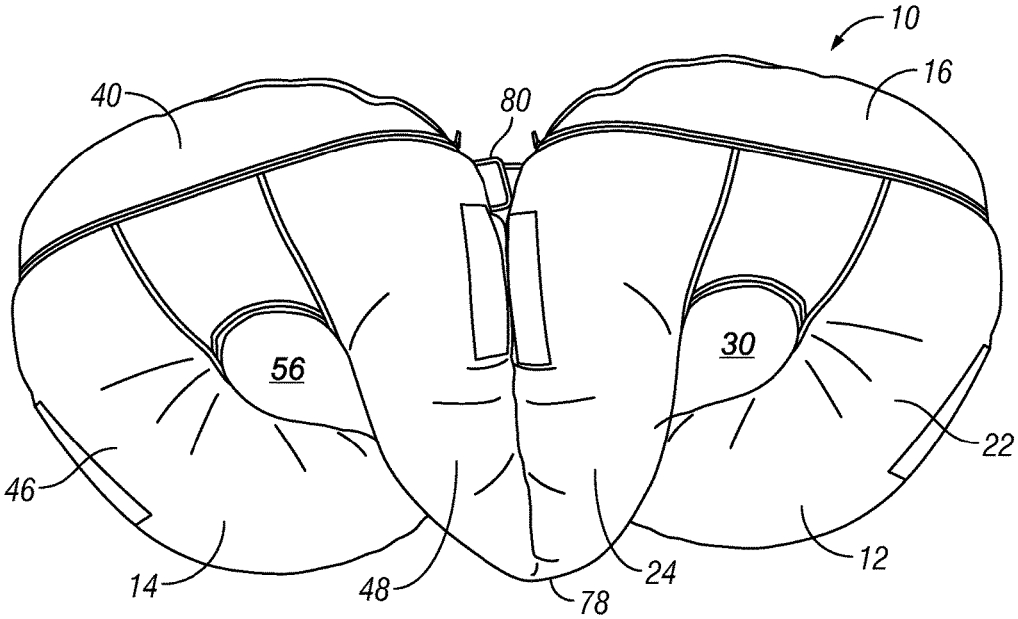
FIG. 8 is a bottom view of the pillow shown in FIG. 7.
Figure 9:
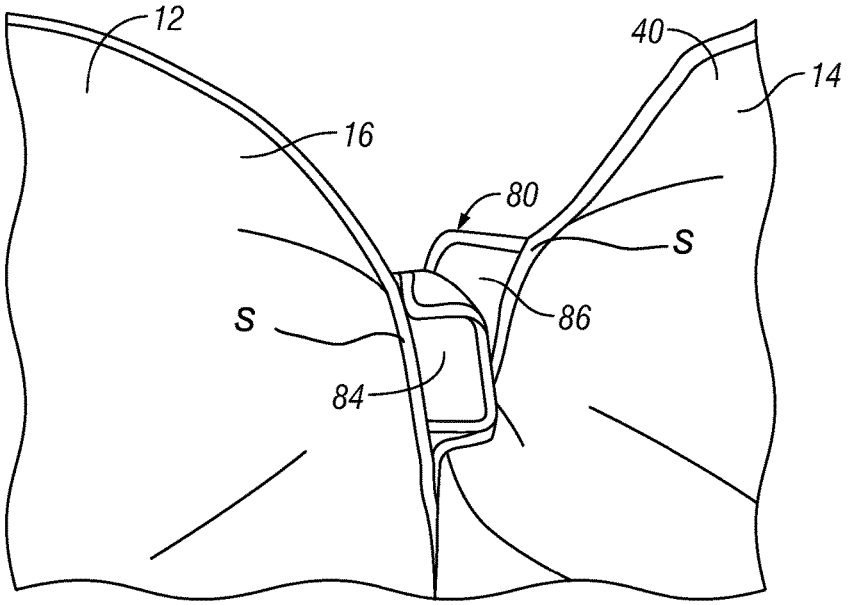
FIG. 9 is an enlarged, fragmented view of the connected tabs at the adjacent sides of the two C-shaped pillow segments in a side-by-side configuration.

With reference now to FIGS. 5-10, the purpose and use of the joint 78 will be explained. There are times when it is desirable to position the infants so that they are facing the same direction, that is, sitting or reclining side-by-side in a flanking position. For example, the two infants may be positioned to face other children in a larger group or to face in the direction of some other activity or form of entertainment. To accommodate this need, the pillow 10 may be folded back upon itself in the same plane along the joint 78, as depicted in FIGS. 7 and 8.

Although not essential, it is advantageous to include a connector assembly 80 for securing the pillow 10 in the second flanking position. The connector assembly may take the form of buttons, snaps, ties, hooks or other suitable device. However, in the preferred practice of the invention, the connector assembly 80 comprises first and second hook-and-loop fasteners in the form of overlapping tabs 84 and 86, one on each of the pillow segments 12 and 14. In a most preferred embodiment, the tabs 84 and 86 are flaps of fabric sewn into a seam S (FIGS. 5&9), which may be formed along the outer perimeter of the pillow cover 62.

The location of the tabs 84 and 86 may vary, but a particularly preferred position is on the second arms 24 and 48 near the center sections 16 and 40. It is to be understood, that the number, size, and configuration of the connectors 84 and 86 may vary. For example, there could two or more sets of connectors, such as several snaps or ties spaced along the length of the second arms 24 and 48. Still further, the connector assembly could be one long fastener extending along the length of the arms 24 and 48, such a length of hook-and-loop fastener or even a zipper.

Figure 10:
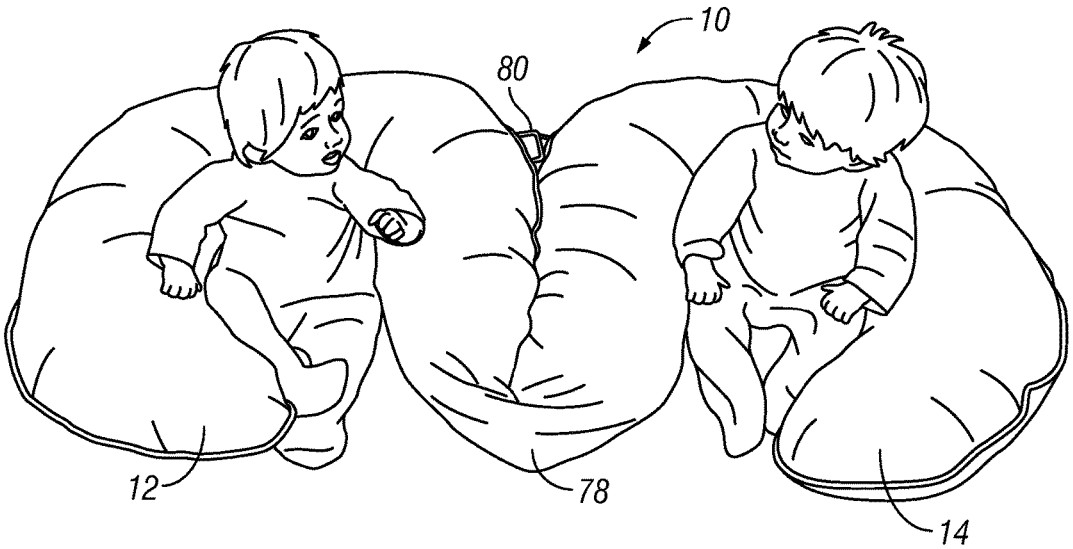
FIG. 10 is a frontal perspective view of a support pillow shown in FIG. 7 with an infant seated in each well.

With the pillow 10 folded, as shown in FIGS. 7, 8, and 10, the pillow takes a second, flanking position, with the joint closed. In this way, the second arm 24 of the first C-shaped segment 12 and the second arm 48 of the second C-shaped segment 14 are adjacent and generally parallel. This is indicated by the parallel dashed lines P1 and P2 in FIG. 7. In this position, the first and second C-shaped segments 12 and 14 are arranged side-by-side with the frontal opening 32 of the well 30 of the first C-shaped segment 12 and the frontal opening 58 of the well 56 of the second C-shaped segment 14 facing in the same direction.

The support pillow 10 may include body wrap assemblies 90 and 92 on each of the C-shaped pillow segments 12 and 14, as shown in FIGS. 11-18, to which attention now is directed. The body wrap assemblies 90 and 92 may be similar to that shown and described in U.S. Pat. No. 6,553,590, entitled "Infant Support Pillow with Body Wrap," issued Apr. 29, 2003, and the contents of that patent are incorporated herein by reference.

As the body wrap assemblies 90 and 92 preferably are similarly formed, only the body wrap assembly 90 on the pillow segment 12 will be described in detail. The preferred body wrap assembly 90 generally comprises a fabric body wrap 94 and a connector assembly 96 for securing the body wrap in position around the infant.

Figure 11:
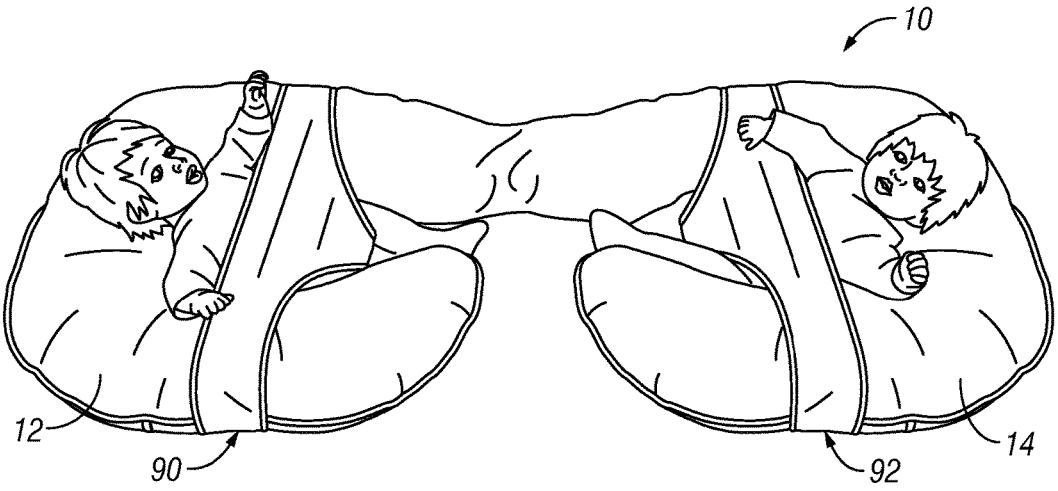
FIG. 11 is a frontal perspective view of a support shown in its resting position with an infant reclining in each well so that they face each other. Each infant is supported with a body wrap.
Figure 12:
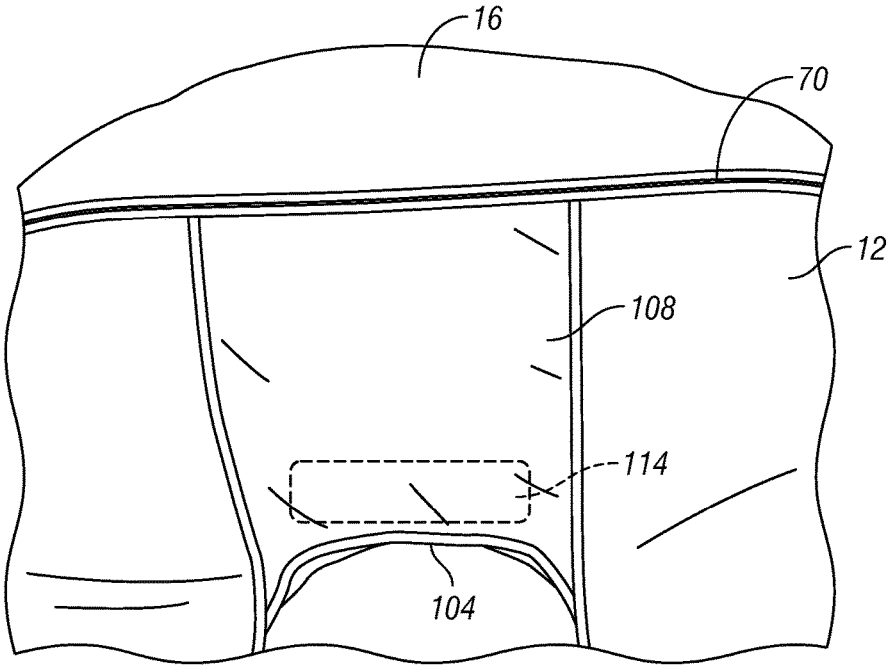
FIG. 12 is an enlarged, fragmented view of the bottom of one of the C-shaped pillow segments showing the pocket for containing the folded body wrap.
Figure 13:
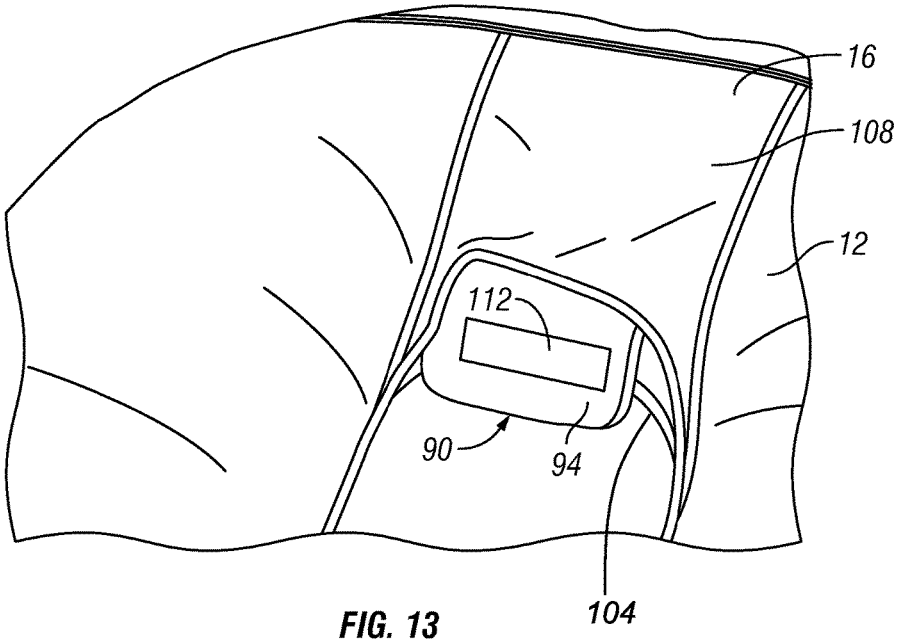
FIG. 13 is an enlarged, fragmented view of the body wrap pocket showing the pocket opened and the hook-and-loop connector on the back side of the body wrap as it starts to be removed from the pocket. The arms of the pillow are omitted to simplify the illustration.
Figure 16:
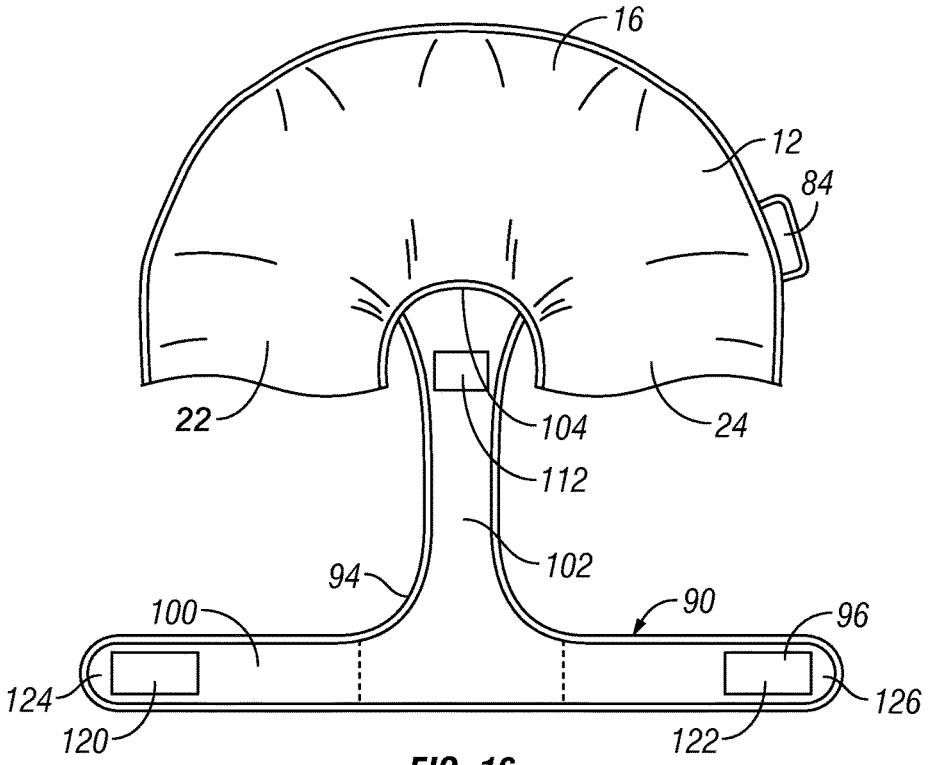
FIG. 16 is a fragmented view of the top of the pillow segment, as seen in FIG. 14, showing the body wrap completely unfurled. The arms of the pillow are omitted to simplify the illustration.
Figure 17:
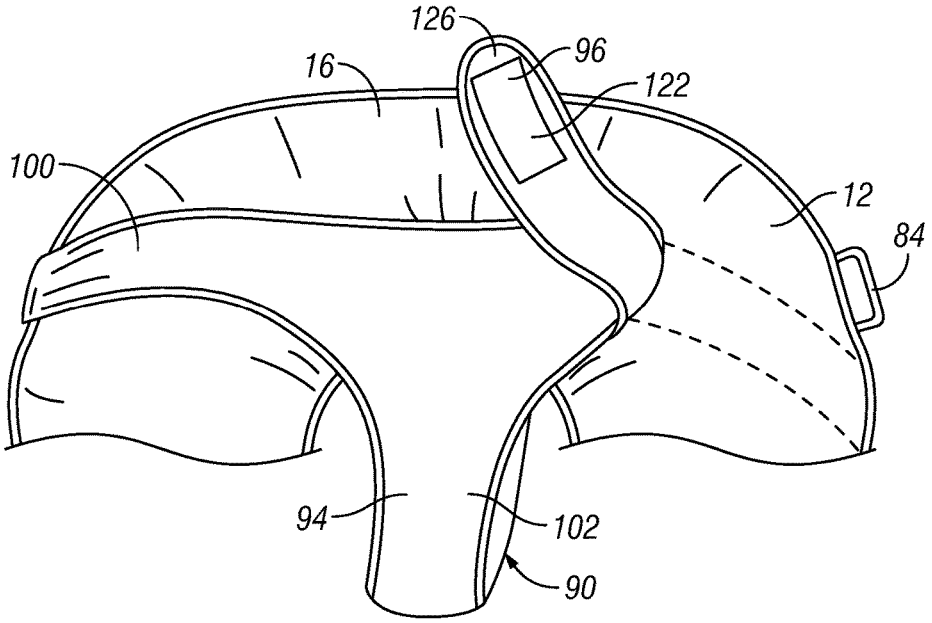
FIG. 17 is a fragmented view of the top of the pillow segment shown in FIG. 14 showing the body wrap unfurled and laid across the central well. The arms of the pillow segment are omitted to simplify the illustration.
Figure 18:
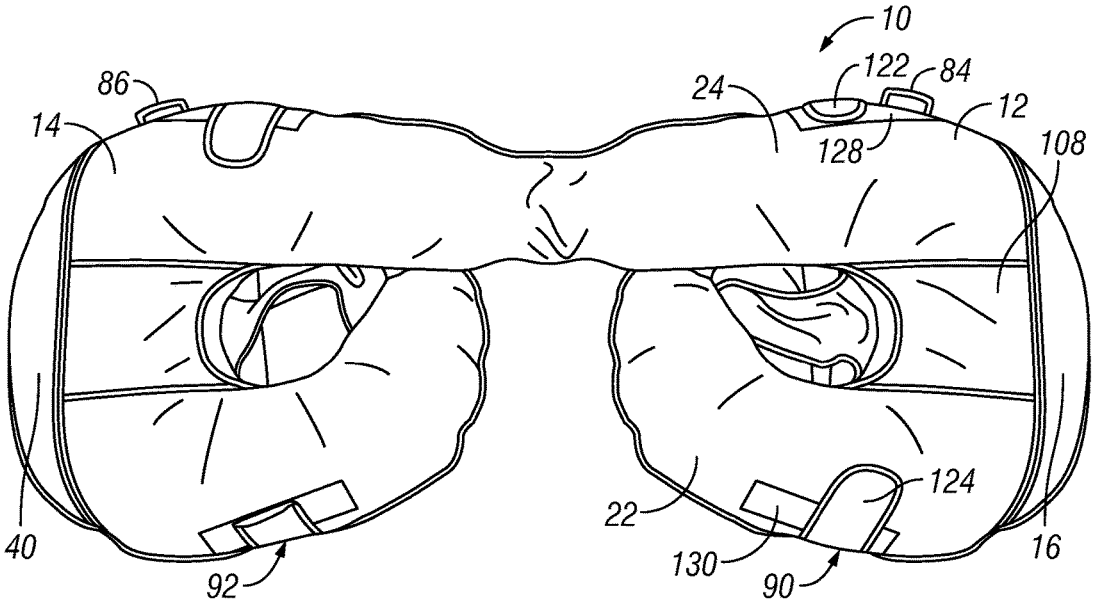
FIG. 18 is a bottom view of the bottom of the support pillow shown in FIG. 11. The infants are not shown to simplify the illustration.

The fabric body wrap 94 preferably is a T-shaped member comprising a transverse strap 100 and a longitudinal strap 102. The transverse strap 100 is configured to extend transversely across the torso of an infant positioned in the central well 30, as shown in FIGS. 11 and 17. The longitudinal strap 102 is configured to extend longitudinally from the center of the transverse strap 100 to the inner periphery 104 (FIGS. 14-16) of the center section passing between the legs of an infant positioned in the central well (FIG. 11).

In most instances, it is desirable to store the body wrap 94 when it is not in use. To that end, the pillow segments 12 and 14 are provided with pockets 108 and 110 (FIG. 3) to receive the rolled or folded body wrap 94. An ideal location for the pocket 108 is on the bottom of the center section 16 adjacent the inner periphery, as seen best in FIGS. 3 and 12-15.

A closure of some sort will secure the body wrap 94 inside the pocket. A simple and effective closure comprises hook-and loop fasteners 112 and 114 on the back of the longitudinal strap 102 near the inner periphery 104 and on the inside of the pocket 108 near the opening. Thus, as illustrated in FIGS. 13-16, the body wrap 94 can be easily folded or rolled up into a compact bundle (FIG. 14) and then pushed into the pocket 108, which is then closed with the fasteners 112 and 114 (shown in broken lines in FIGS. 12-15.

Figure 14:
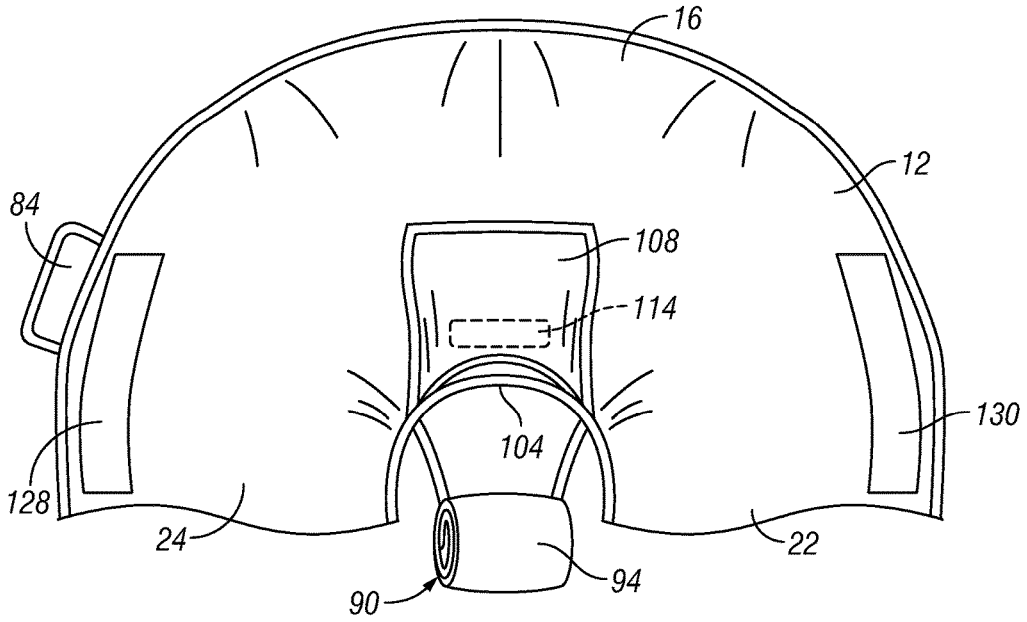
FIG. 14 is a fragmented view of the bottom of the pillow segment showing the body wrap partially unfurled. The arms of the pillow are omitted to simplify the illustration.
Figure 15:
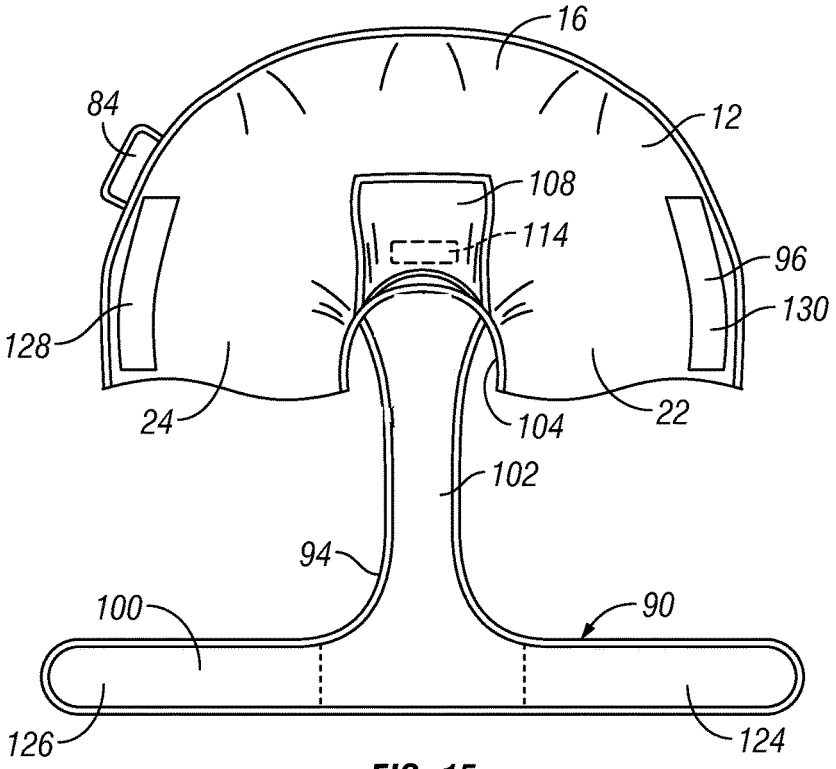
FIG. 15 is a fragmented view of the bottom of the pillow segment, as seen in FIG. 14, showing the body wrap completely unfurled. The arms of the pillow segment are omitted to simplify the illustration.

Hook-and-loop fasteners also are ideal for the connector assembly 96. Strips 120 and 122 of the fastener may be provided on the ends 124 and 126 of the transverse strap 100, as seen in FIG. 16. Mating strips 128 and 130 then may be affixed to the underside of the pillow segment 12 near the juncture of the arms 22 and 24 and the center section 16, as seen in FIGS. 14 and 15. The hook-and-loop fasteners 120, 122, and 128, 130 allow for adjusting the snugness of the body wrap 94 around the infant.

The ideal cross-sectional shape for the pillow 10 is generally cylindrical, that is, generally circular in cross-section. The width or diameter of the arms 22, 24 and 46, 48 usually will be in the range of about 4 to about 10 inches. The width or diameter of the center sections 16 and 40 preferably is slightly larger and may be about 8 to about 18 inches. The overall length of the pillow 10 in the resting position (FIGS. 1&2) is about 36 to about 60 inches from the outer edge of the center section 16 to the outer edge of the center section 40. The overall width of each of the pillow segments 12 and 14 from the outer edge of the first arm to the outer edge of the second arm may be about 30 to about 50 inches. However, all of these dimensions are variable.

Having described a preferred structure for the support pillow 10 of the present invention, its use now will be explained. As previously described, one use for the pillow 10 in its resting position is shown in FIG. 1. Two infants may sit or recline in the pillow segments 12 and 14 in a face-to-face opposing position. As is also previously described, the pillow 10 can be folded at the joint 78 so that the infants are positioned side-by-side in a flanking arrangement. In either position, the infants may or may not be supported with a body wrap, as illustrated in FIG. 11. Also, in either position, the infants may be positioned on their tummies for play time.

Figure 20:
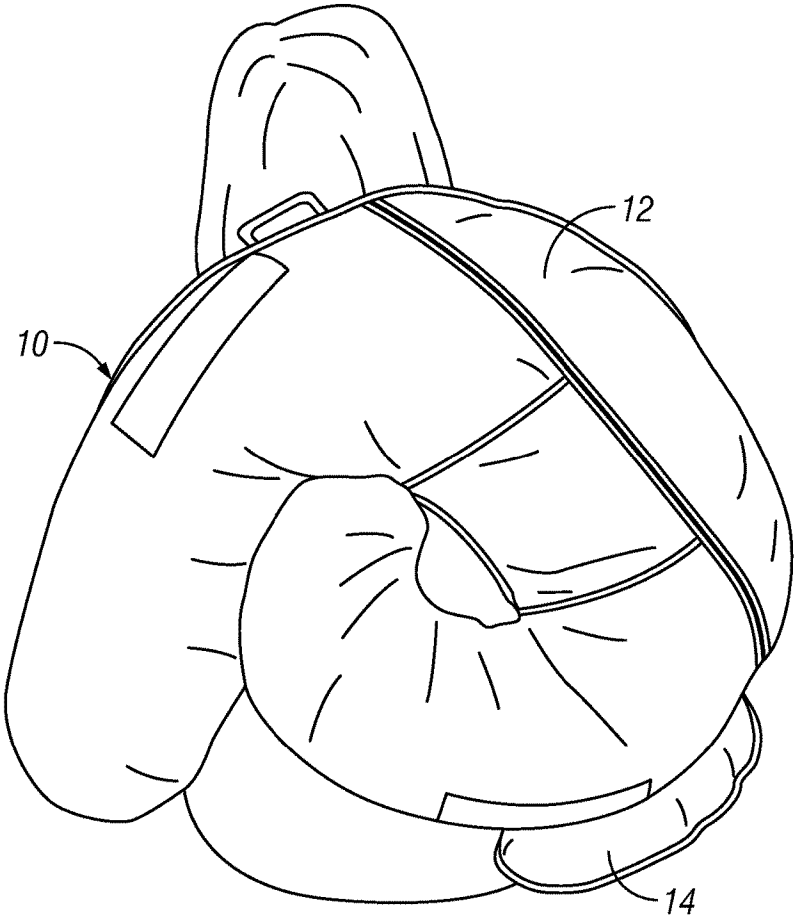
FIG. 20 is a rear view of the woman shown in FIG. 19. The chair is omitted to simplify the illustration.
Figure 19:
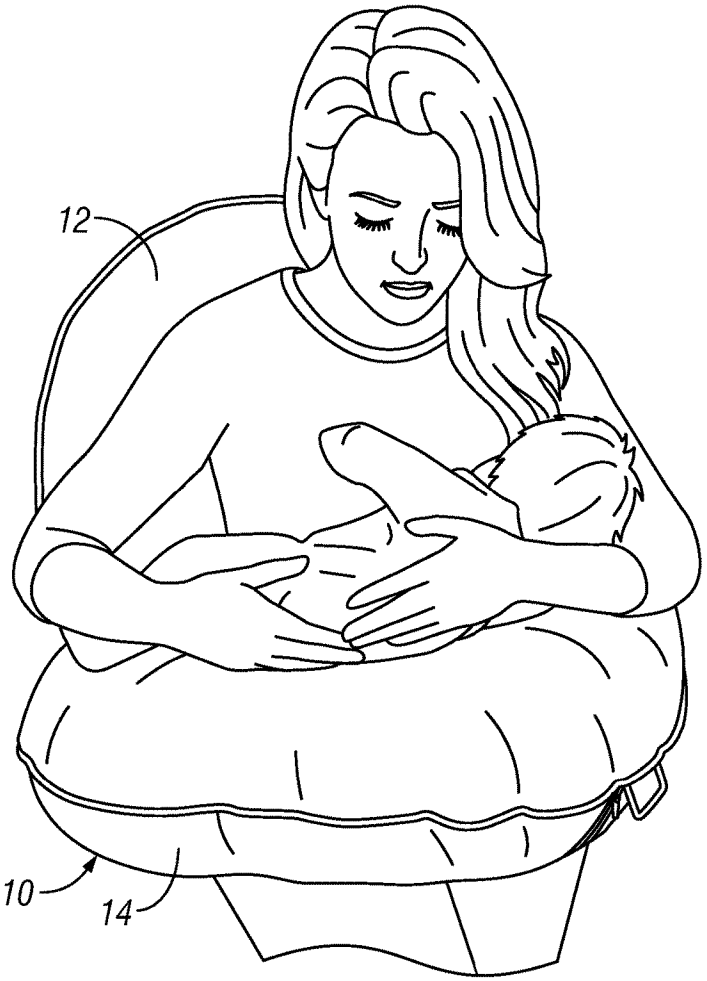
FIG. 19 is a front view of a woman seated using the support pillow as a nursing pillow; one pillow segment supports her back, and one supports the infant on her lap.

With reference now to FIGS. 19-25, several alternate uses for the support pillow 10 will be shown and described. In FIGS. 19 and 20, the pillow 10 is in use by a mother or care giver to nurse and/or cradle an infant in her lap. One pillow segment 14 is curled across her lap, and the other pillow segment 12 supports her back.

Figure 21:
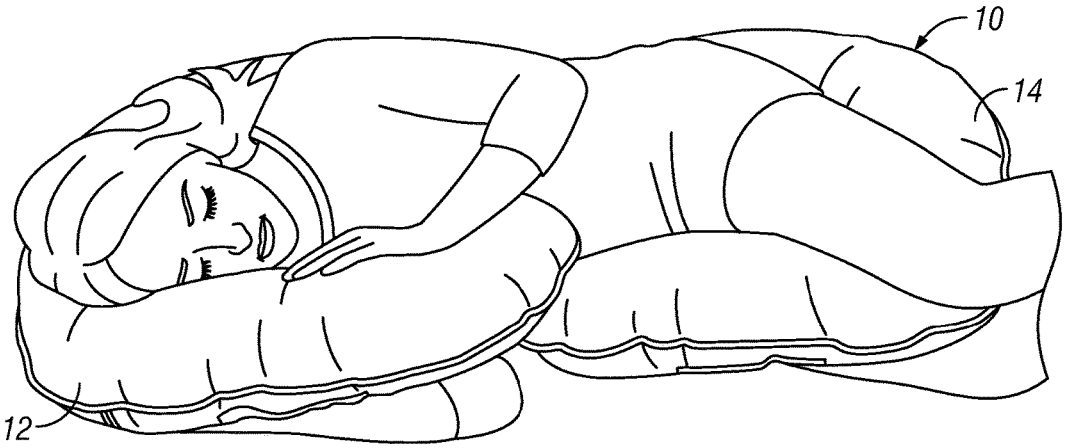
FIG. 21 is a side view of a woman lying on her right side using the support pillow as a full body pillow.

FIG. 21 illustrates how the support pillow 10 in the resting or unfolded position serves well as a full body pillow or maternity pillow for a woman shown resting on one side. Of course, the user could lie on either side.

Figure 22:
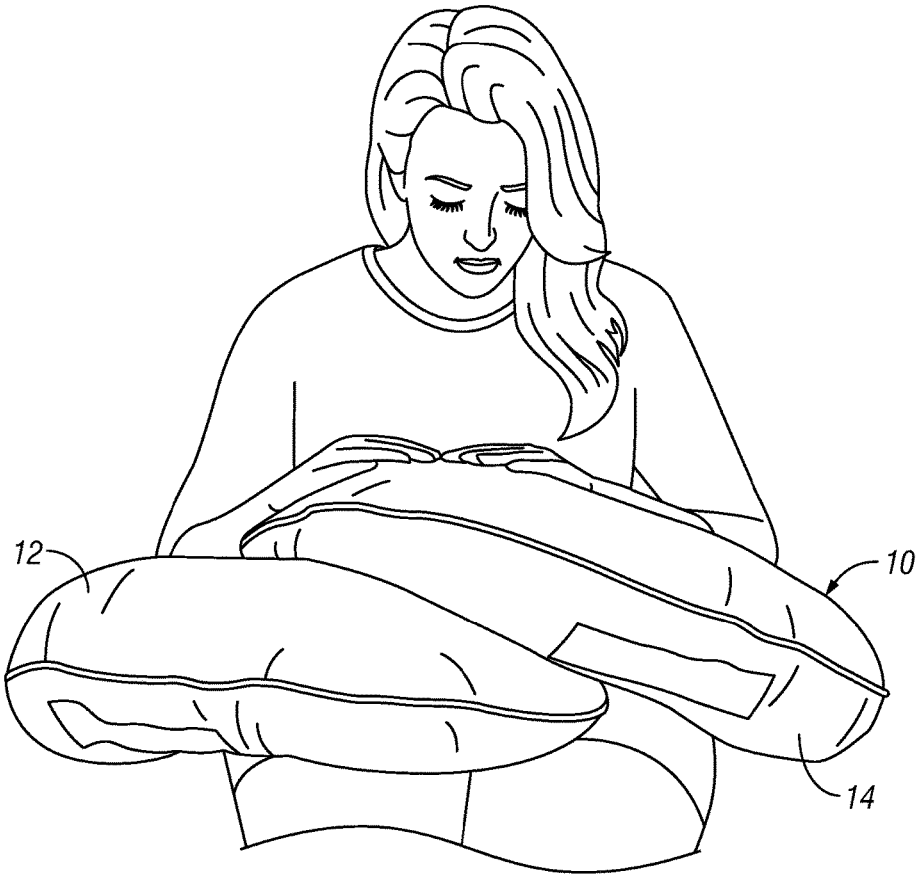
FIG. 22 is a front view of a woman seated using the support pillow as a study or reading pillow; the folded portion of the pillow is behind her back and the two pillow segments are overlapping on her lap.
Figure 23:
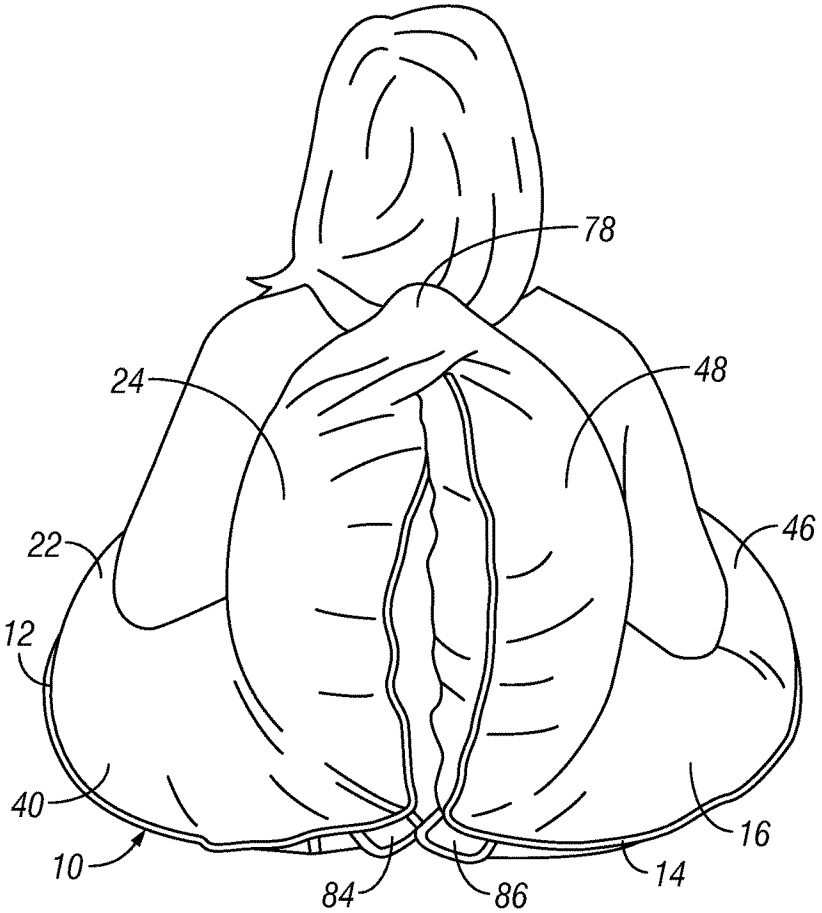
FIG. 23 is a rear view of the woman shown in FIG. 22. The chair is omitted to simplify the illustration.

FIGS. 22 and 23 show how the pillow 10 may serve as a combination back and lap pillow. With the joint 78 closed and the connectors 84 and 86 attached to each other, the arms 24 and 48 form a vertical back support, as seen in FIG. 23. The arms 22 and 46 are overlapped across the woman's lap to service as a support for a meal tray or other work surface.

Figure 24:
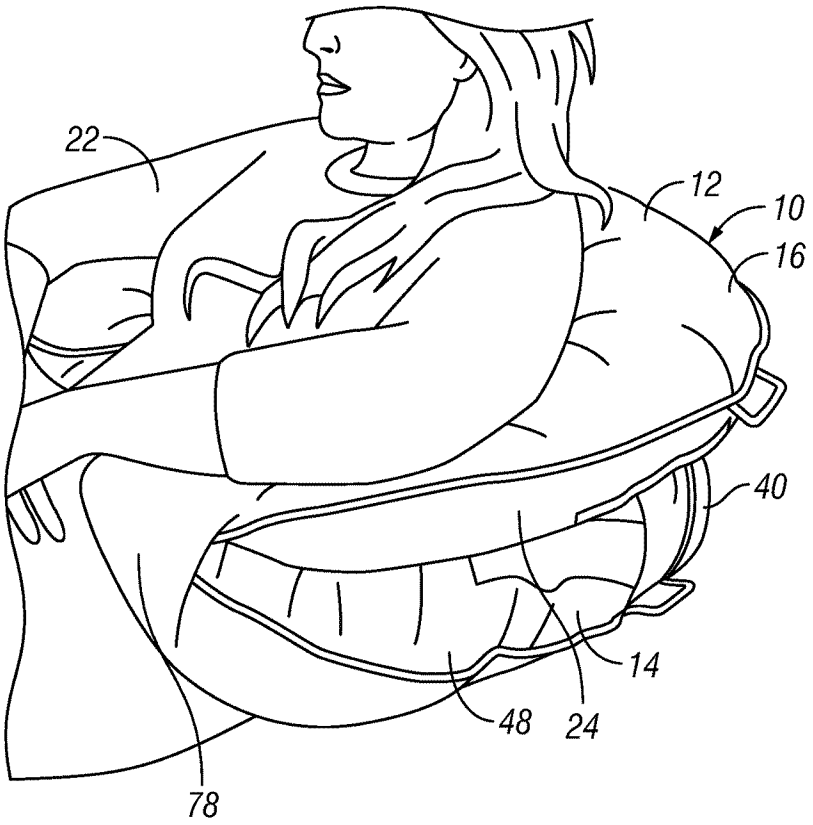
FIG. 24 is a side view of a woman using the support pillow, one segment folded over the other, as a back support pillow or study pillow.
Figure 25:
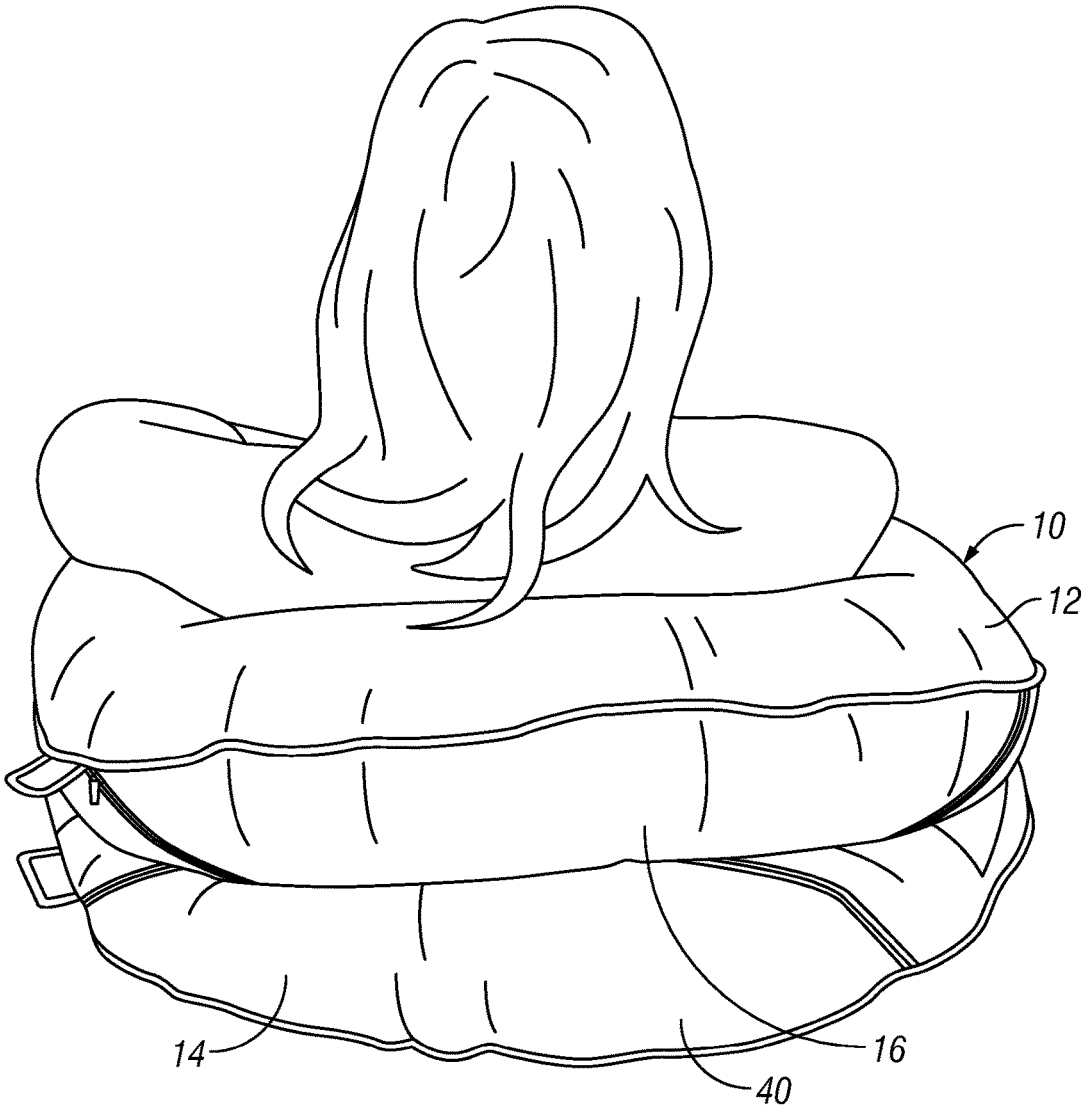
FIG. 25 is a back view of the woman shown in FIG. 24.

By folding one C-shaped pillow segment 12 over the other segment 14, a comfortable lounging or study pillow is formed, as seen in FIGS. 24 and 25. The pillow 10 creates a deep, C-shaped, double-thickness arrangement that is open in the front but has some support on the sides for the user's arms.

Now it will be appreciated that the pillow 10 of the present invention has many desirable features and advantages. It is ideal for use with twins or two babies of any size or age, but has uses for adults and older children as well. These and other uses and configurations will be readily apparent from the unique structure of this inventive pillow.

The support pillow shown and described herein has some features in common with the pillow shown and described in U.S. Pat. No. 7,562,406, entitled "Reconfigurable Support Pillow with Tandem Wells," issued Jul. 21, 2009, and the contents of that patent are incorporated herein by reference.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A support pillow comprising:

a first C-shaped segment comprising a center section with first and second ends, a first arm extending from the first end of the center section, and a second arm extending from the second end of the center section, wherein the first arm has a free end opposite the center section, wherein the second arm has an end opposite the center section, wherein the C-shaped segment forms a central well sized to receive an infant, and wherein the free end of the first arm and the end of the second arm form a frontal opening to the well;

a second C-shaped segment comprising a center section with first and second ends, a first arm extending from the first end of the center section, and a second arm extending from the second end of the center section, wherein the first arm has a free end opposite the center section, wherein the second arm has an end opposite the center section, wherein the C-shaped segment forms a central well sized to receive an infant, and wherein the free end of the first arm and the end of the second arm form a frontal opening to the well;

a joint connecting the end of the second arm of the first C-shaped segment and the end of the second arm of the second C-shaped segment;

wherein each of the first and second C-shaped segments is comprised of compressible, resilient material;

wherein, when the support pillow is in a first, opposing position with the joint open so that the second arm of the first C-shaped segment and the second arm of the second C-shaped segment are generally co-linear, the first and second C-shaped segments are arranged face-to-face with the frontal opening of the well of the first C-shaped segment opposite the frontal opening of the well of the second C-shaped segment; and wherein, when the support pillow is positionable in a second, flanking position, with the joint closed so that the second arm of the first C-shaped segment and the second arm of the second C-shaped segment are adjacent and generally parallel, the first and second C-shaped segments are arranged side-by-side with the frontal opening of the well of the first C-shaped segment and the frontal opening of the well of the second C-shaped segment facing in the same direction.

2. The support pillow of claim 1 wherein the first and second C-shaped segments are about the same size.

3. The support pillow of claim 1 comprising an outer removable cover and wherein the compressible, resilient material is contained in at least one pillow insert.

4. The support pillow of claim 3 wherein the cover is unitary.

5. The support pillow of claim 4 wherein the at least one pillow insert comprises two C-shaped inserts.

6. The support pillow of claim 5 further comprising a connector assembly for securing the pillow in the second flanking position.

7. The support pillow of claim 6 wherein the connector assembly comprises a first connector on the second arm of the first C-shaped segment and a second connector on the second arm of the second C-shaped segment, the first and second connectors being connectable to each other.

8. The support pillow of claim 7 wherein the first and second connectors comprise hook-and-loop type fasteners.

9. The support pillow of claim 1 further comprising a connector assembly for securing the pillow in the second flanking position.

10. The support pillow of claim 9 wherein the connector assembly comprises a first connector on the second arm of the first C-shaped segment and a second connector on the second arm of the second C-shaped segment, the first and second connectors being connectable to each other.

11. The support pillow of claim 10 wherein the first and second connectors comprise hook-and-loop type fasteners.

12. The support pillow of claim 1 wherein each of the first and second C-shaped segments further comprises a body wrap assembly, each body wrap assembly comprising a fabric body wrap and a connector assembly.

13. The support pillow of claim 12 wherein each of the first and second C-shaped segments includes a pocket sized to enclose the fabric body wrap in a rolled or folded condition.

14. The support pillow of claim 12 wherein the center section of each of the first and second C-shaped segments includes an inner perimeter, wherein the fabric body wrap comprises a transverse strap and a longitudinal strap, wherein the transverse strap is configured to extend transversely across the torso of an infant positioned in the central well, and wherein the longitudinal strap is configured to extend longitudinally from the center of the transverse strap to the inner perimeter of the center section passing between the legs of an infant positioned in the central well.

15. The support pillow of claim 1 wherein the support pillow comprises an outer, removable, unitary cover, wherein the compressible, resilient material is contained in first and second similarly sized C-shaped pillow inserts, wherein each of the first and second pillow inserts comprises a center section and first and second arms generally corresponding to the center section and first and second arms of the respective first and second C-shaped pillow segments, wherein each of the second arms of the first and second pillow inserts terminates in a free end, and wherein the free ends of the second arms of the first and second pillow inserts, when positioned inside the cover, are spaced a distance apart forming the joint.

16. A method for supporting two infants, the method comprising:

providing a support pillow that comprises:

a first C-shaped pillow segment comprising a center section with first and second ends, a first arm extending from the first end of the center section, and a second arm extending from the second end of the center section, wherein the first arm has a first end opposite the center section, wherein the second arm has an end opposite the center section, wherein the C-shaped segment forms a central well sized to receive an infant, and wherein the free end of the first arm and end of the second arm form a frontal opening to the well;

a second C-shaped pillow segment comprising a center section with first and second ends, a first arm extending from the first end of the center section, and a second arm extending from the second end of the center section, wherein the first arm has a free end opposite the center section, wherein the second arm has an end opposite the center section, wherein the C-shaped segment forms a central well sized to receive an infant, and wherein the free end of the first arm and the end of the second arm form a frontal opening to the well;

a joint connecting the end of the second arm of the first C-shaped segment and the end of the second arm of the second C-shaped segment;

wherein each of the first and second C-shaped segments is comprised of compressible, resilient material;

wherein, when the support pillow is in a first, opposing position with the joint open so that the second arm of the first C-shaped segment and the second arm of the second C-shaped segment are generally co-linear, the first and second C-shaped segments are arranged face-to-face with the frontal opening of the well of the first C-shaped segment opposite the frontal opening of the well of the second C-shaped segment; and wherein, when the support pillow is positionable in a second, flanking position, with the joint closed so that the second arm of the first C-shaped segment and the second arm of the second C-shaped segment are adjacent and generally parallel, the first and second C-shaped segments are arranged side-by-side with the frontal opening of the well of the first C-shaped segment and the frontal opening of the well of the second C-shaped segment facing in the same direction;

while the support pillow is configured in the first, opposing position, placing an infant in the central well of each of the first and second C-shaped segments; and while the support pillow is configured in the second, flanking position, placing an infant in the central well of each of the first and second C-shaped segments.

17. The method of claim 16 further comprising, after placing the infants in the C-shaped segments, supporting each infant with a fabric body wrap.

18. A cover for a support pillow, wherein the cover comprises:

a first C-shaped segment shaped to conform to a first C-shaped support pillow comprising a center section with first and second ends, a first arm extending from the first end of the center section, and a second arm extending from the second end of the center section, wherein the first arm has a free end opposite the center section, wherein the second arm has an end opposite the center section, wherein the C-shaped support pillow forms a central well sized to receive an infant, and wherein the free end of the first arm and the end of the second arm form a frontal opening to the well;

a second C-shaped segment shaped to conform to a second C-shaped support pillow comprising a center section with first and second ends, a first arm extending from the first end of the center section, and a second arm extending from the second end of the center section, wherein the first arm has a free end opposite the center section, wherein the second arm has an end opposite the center section, wherein the C-shaped support pillow forms a central well sized to receive an infant, and wherein the free end of the first arm and the end of the second arm form a frontal opening to the well;

a joint connecting the end of the second arm of the first C-shaped segment and the end of the second arm of the second C-shaped segment;

wherein, when the support pillow cover is in a first, opposing position with the joint open so that the second arm of the first C-shaped segment and the second arm of the second C-shaped segment are generally co-linear, the first and second C-shaped segments are arranged face-to-face with the frontal opening of the well of the first C-shaped segment opposite the frontal opening of the well of the second C-shaped segment; and wherein, when the support pillow cover is positionable in a second, flanking position, with the joint closed so that the second arm of the first C-shaped segment and the second arm of the second C-shaped segment are adjacent and generally parallel, the first and second C-shaped segments are arranged side-by-side with the frontal opening of the well of the first C-shaped segment and the frontal opening of the well of the second C-shaped segment facing in the same direction.

19. The support pillow cover of claim 18 wherein the first and second C-shaped segments are about the same size.

20. The support pillow cover of claim 18 wherein the cover is unitary.

21. The support pillow cover of claim 18 further comprising a connector assembly for securing the pillow cover in the second flanking position.

22. The support pillow cover of claim 21 wherein the connector assembly comprises a first connector on the second arm of the first C-shaped segment and a second connector on the second arm of the second C-shaped segment, the first and second connectors being connectable to each other.

23. The support pillow cover of claim 22 wherein the first and second connectors comprise hook-and-loop type fasteners.

24. The support pillow cover of claim 18 wherein each of the first and second C-shaped segments further comprises a body wrap assembly, each body wrap assembly comprising a fabric body wrap and a connector assembly.

25. The support pillow cover of claim 24 wherein each of the first and second C-shaped segments includes a pocket sized to enclose the fabric body wrap in a rolled or folded condition.

26. The support pillow cover of claim 24 wherein the center section of each of the first and second C-shaped segments includes an inner perimeter, wherein the fabric body wrap comprises a transverse strap and a longitudinal strap, wherein the transverse strap is configured to extend transversely across the torso of an infant positioned in the central well, and wherein the longitudinal strap is configured to extend longitudinally from the center of the transverse strap to the inner perimeter of the center section passing between the legs of an infant positioned in the central well.

* * * * *